US005239735A

United States Patent [19]

Tanaka et al.

[11] Patent Number: 5,239,735

[45] Date of Patent: Aug. 31, 1993

[54] METHOD FOR MANUFACTURING EXPANDED MESH SHEET

[75] Inventors: Masahiro Tanaka, Hirakata; Hiroyuki Kobayashi, Yawata; Akira Inanobe, Toyohashi; Yoshio Goda, Yao, all of Japan

[73] Assignee: Matsushita Electric Industrial Co., Ltd., Osaka, Japan

[21] Appl. No.: 886,925

[22] Filed: May 22, 1992

Related U.S. Application Data

[62] Division of Ser. No. 635,703, Dec. 28, 1990, Pat. No. 5,136,765.

[30] Foreign Application Priority Data

Dec. 28, 1989 [JP] Japan ..... 1-344095

[51] Int. Cl.[5] ..... B21D 31/04

[52] U.S. Cl. ..... 29/6.1

[58] Field of Search ..... 29/6.1, 6.2

[56] References Cited

U.S. PATENT DOCUMENTS

| | | |
|---|---|---|
| 1,578,366 | 3/1926 | Redding et al. . |
| 1,927,542 | 9/1933 | Coryell . |
| 4,297,866 | 11/1981 | Sakauye et al. . |
| 4,303,747 | 12/1981 | Bender . |
| 4,305,187 | 12/1981 | Iwamura et al. . |
| 4,315,356 | 2/1982 | Laurie et al. . |
| 4,649,607 | 3/1987 | Kuhn, II . |
| 4,921,118 | 5/1990 | Gass . |

FOREIGN PATENT DOCUMENTS

| | | | |
|---|---|---|---|
| 32529 | 2/1983 | Japan | 29/6.1 |
| 90326 | 5/1983 | Japan | 29/6.1 |
| 60-29573 | 7/1985 | Japan . | |
| 2034610 | 6/1980 | United Kingdom . | |
| 2054438 | 2/1981 | United Kingdom . | |
| 2120138 | 11/1983 | United Kingdom . | |

*Primary Examiner*—Timothy V. Eley

*Attorney, Agent, or Firm*—Wenderoth, Lind & Ponack

[57] ABSTRACT

A method for manufacturing an expanded mesh sheet, includes the steps of: forming a plurality of slits on a strip at predetermined pitches to simultaneously form a plurality of strip-shaped lift portions and connecting portions for connecting the strip-shaped lift portions to each other in a lattice pattern, the slits each being intermittently formed in a longitudinal direction of the strip and the adjacent slits in a widthwise direction of the strip being shifted to each other in the longitudinal direction of the strip; and expanding the strip in the widthwise direction thereof. An apparatus for manufacturing the sheet, includes: a pair of rolls engaged to each other, each roll having a plurality of disk-shaped cutters; and a driving device for driving the rolls for rotation. Each cutter has a cutting edge portion and a relief on a periphery thereof at predetermined pitches to form slits, each of which extends in a longitudinal direction of the strip, on the strip by the cutting edge portions of the cutters of the rolls to form strip-shaped lift portions and to form a connecting portion for connecting the strip-shaped lift portions to each other on a position between the slits on an extending direction of the slits by the reliefs of the cutters of the rolls.

3 Claims, 11 Drawing Sheets

METHOD FOR MANUFACTURING EXPANDED MESH SHEET

This is a Divisional application of Ser. No. 07/635,703, filed Dec. 28, 1990 now U.S. Pat. No. 5,136,765.

BACKGROUND OF THE INVENTION

The present invention relates to a method for manufacturing an example mesh sheet such as a latticed electrode for use in a battery and a manufacturing apparatus for carrying out the method.

As shown in FIG. 18, in an example mesh sheet, many strip-shaped lift portions (a) are connected with each other in a zigzag configuration by a latticed connecting portion (b). An apparatus for manufacturing such an example mesh sheet is proposed in Japanese Patent Publication No. 60-29573.

According to this conventional art, as shown in FIGS. 15(*a*) and 15(*b*), a plurality of slits (c) are intermittently formed on a strip (A) in the longitudinal direction thereof as the first process. In this stage, the slits (c) are arranged in parallel with each other on the strip (A) and the strip-shaped lift portion (a) is formed by the adjacent slits (c). At this time, the strip-shaped lift portions (a) adjacent to each other in the widthwise direction of the strip (A) are shaped by curvedly bend it in the direction opposite to each other and approximately in the thickness direction of the strip. A flat portion (d) is positioned widthwise in a belt-like configuration between the slits.

As shown in FIG. 17, the first process is carried out by a first roll (g) comprising a plurality of diskshaped cutters (f), having projections (e) provided at predetermined pitches in the periphery thereof, superimposed one on the other other at predetermined intervals and a second roll (h). Each strip-shaped lift portion (a) is pressed against the projection (e) approximately in the thickness direction of the strip and shaped by curvedly bend it between adjacent flat portions (d).

As shown in FIGS. 16(*a*) and 16(*b*), a slit (i) for connecting the adjacent slits (c) is formed in the flat portion (d) in the second process. The slit (i) is formed alternately-widthwise and formed in every other flat portion (d). The portion between the slits (i) adjacent to each other widthwise serves as the connecting portion (b).

The second process is performed by the second roll (h) and a third roll (j) as shown in FIG. 17. The third roll (j) comprises a plurality of disk-shaped cutters (k), having the projection (e) not formed thereon, superimposed one on the other and reliefs (1) are provided at predetermined pitches in the right and left sides alternately on both sides of the periphery of the disk-shaped cutter (k). Similarly, the relief (1) is provided on the disk-shaped cutter (f) of the second roll (h) and opposed to the relief (1) of the disk-shaped cutter (k).

In the third process, the strip (A) having the strip-shaped lift portion (a) and the connecting portion (b) formed thereon is extendably expanded widthwise as shown in FIG. 18.

However, the conventional art has the following issues:

1. Slits are formed in two processes and the use of two rolls are necessary for each process. Therefore, time-taking adjustments such as positioning between the two rolls and the rotating timing thereof are required to be made before starting a work, and there is a fear that a strip is cut two times.

It is necessary to use three kinds of disk-shaped cutters in the example shown in the drawings and in addition, the disk-shaped cutter of the roll used in both processes is consumed in a short time by a side pressure applied by the two rolls.

2. In shaping the strip, the strip-shaped lift portion is pressed by the top portion of the projection of the disk-shaped cutter and pulled in the rotational direction of the disk-shaped cutter, with the result that tensile stress concentrates on the rear portion of the strip-shaped lift portion. In the conventional manufacturing apparatus, as shown in FIG. 19, the projection (e) is longitudinally symmetrical with respect to a line, the top portion (m) thereof is positioned in the center in the rotational direction of the disk-shaped cutter, and the length of the rear portion of the strip is only half of the whole length of the strip-shaped lift portion (a). Therefore, the thickness of the rear portion of the strip is locally reduced and as such, the strip is likely to break when it is expanded.

3. According to the conventional apparatus, the relief (1) thicknesses of the disk-shaped cutters (f) and (j) are approximately the same in the base portion and peripheral portion thereof as shown in FIG. 20. Therefore, the disk-shaped cutter is likely to break in the base portion thereof. In particular, the disk-shaped cutter of the roll used in the two processes is likely to be damaged by the side pressure as described in item 1.

4. As shown in FIG. 21, with the expansion of the strip in the widthwise direction thereof, the connecting portions (b) adjacent to each other widthwise are separated from each other widthwise, with the result that first, the strip-shaped lift portion (a) is twisted, then, each connecting portion (b) rotates in the twist-removing direction. Thereafter, each strip-shaped lift portion (a) is bent with respect to the connecting portion (b) in the direction in which each strip-shaped lift portion (a) has been curved, with the result that the separation of the adjacent connecting portions (b) progresses.

As described above, according to the conventional art, the strip-shaped lift portion is twisted when an expanding starts. Therefore, a great force is required in the expanding operation, so that the longevity of an apparatus for the expanding operation becomes short.

This issue is outstanding when the thickness of the strip is large or a mesh is fine.

SUMMARY OF THE INVENTION

Accordingly, an essential object of the present invention is to provide a method for manufacturing an expanded mesh sheet in which slits are formed in one process and an apparatus to be used for carrying out the method.

Another important object of the present invention is to provide an apparatus, for manufacturing an expanded mesh sheet, which does not damage the rear portion of a strip-shaped lift portion in a short time.

A further object of the present invention is to provide an apparatus, for manufacturing an expanded mesh sheet, which does not damage the relief of a disk-shaped cutter in a short time.

A still another object of the present invention is to provide an apparatus, for manufacturing an expanded mesh sheet, capable of expanding a strip with a small force while the strip-shaped lift portion of the strip is being expanded.

In accomplishing these and other objects, according to one aspect of the present invention, there is provided a method for manufacturing an expanded mesh sheet, comprising the steps of: forming a plurality of slits on a strip at predetermined pitches to simultaneously form a plurality of strip-shaped lift portions and connecting portions for connecting the strip-shaped lift portions to each other in a lattice pattern, the slits each being intermittently formed in a longitudinal direction of the strip and the adjacent slits in a widthwise direction of the strip being shifted to each other in the longitudinal direction of the strip; and expanding the strip in the widthwise direction thereof.

According to another aspect of the present invention, there is provided an apparatus for manufacturing an expanded mesh sheet, comprising: a pair of rolls engaged to each other, each roll having a plurality of disk-shaped cutters concentrically located and spaced between the adjacent cutters at approximately the same interval as thickness of the cutter to form slits on a strip, rotary axes of the rolls being parallel to each other and the rolls being shifted in the axes to each other at the interval so that peripheral edge of each cutter is inserted into the interval between adjacent cutters to which the cutter is opposed; and a driving means for driving the rolls for rotation, each cutter having a cutting edge portion and a relief on a periphery thereof at predetermined pitches to form slits, each of which extends in a longitudinal direction of the strip, on the strip by the cutting edge portions of the cutters of the rolls to form strip-shaped lift portions and to form a connecting portion for connecting the strip-shaped lift portions to each other on a position between the slits on an extending direction of the slits by the reliefs of the cutters of the rolls.

According to the aspects of the present invention, slits for providing the strip-shaped lift portion and the connecting portion can be simultaneously formed by one pair of rolls. Thus, an adjusting operation to be performed before an expanding work starts can be easily carried out, and there is no fear that the strip is cut twice. Further, only one kind of disk-shaped cutter suffices, and the consumption degree of each disk-shaped cutter can be made to be uniform.

According to a further aspect of the present invention, there is provided the apparatus for manufacturing an expanded mesh sheet, wherein the cutting edge portion is formed in approximately triangular shape in which a top portion of the cutting edge portion is shifted towards a front side thereof relative to a bottom side thereof in a rotational direction of the corresponding roll and a portion positioned from the top portion towards a rear side thereof in the rotational direction is projected in an outwardly radial direction of the cutter to form a curved portion.

According to the aspect of the present invention, since the top portion of the projection is displaced towards the front side relative to the bottom side of the projection in the rotational direction of the disk-shaped cutter, the length of the rear portion of the strip-shaped lift portion can be increased. Further, since the curved portion is provided in the rear portion of the projection, the thickness reduction of the rear portion of the strip-shaped lift portion can be made to be uniform in shaping the stripshaped lift portion. Consequently, the thickness reduction thereof can be prevented from locally occurring and the breakage of the strip-shaped lift portion ca be reduced during expanding.

According to a still another aspect of the present invention, there is provided the apparatus for manufacturing an expanded mesh sheet, wherein the relief is so formed by an inclined surface of the periphery of the cutter that a peripheral area of the relief is larger than a bottom area thereof.

According to the aspect of the present invention, since the thickness of a portion corresponding to the relief of the disk-shaped cutter can be increased in the base portion side, the pressure resistant strength of this portion can be increased, and the durability of the disk-shaped cutter can be improved.

According to a still another aspect of the present invention, there is provided the apparatus for manufacturing an expanded mesh sheet, further comprising an expanding means for expanding the strip having the strip-shaped lift portion and the connecting portion in an approximately thickness direction of the strip except for a center portion of the strip in a widthwise direction of the strip.

According to the aspect of the present invention, since the strip having the strip-shaped lift portion and the connecting portion formed thereon is expanded in the direction approximately perpendicular to the strip surface, the strip-shaped lift portion can be bent with respect to the connecting portion in the direction in which the stripshaped lift portion has been curved, and the strip-shaped lift portion is not twisted unlike the conventional art. Therefore, the strip-shaped lift portion can be expanded with a comparatively small force.

DETAILED DESCRIPTION OF THE EMBODIMENTS

Figure 1:
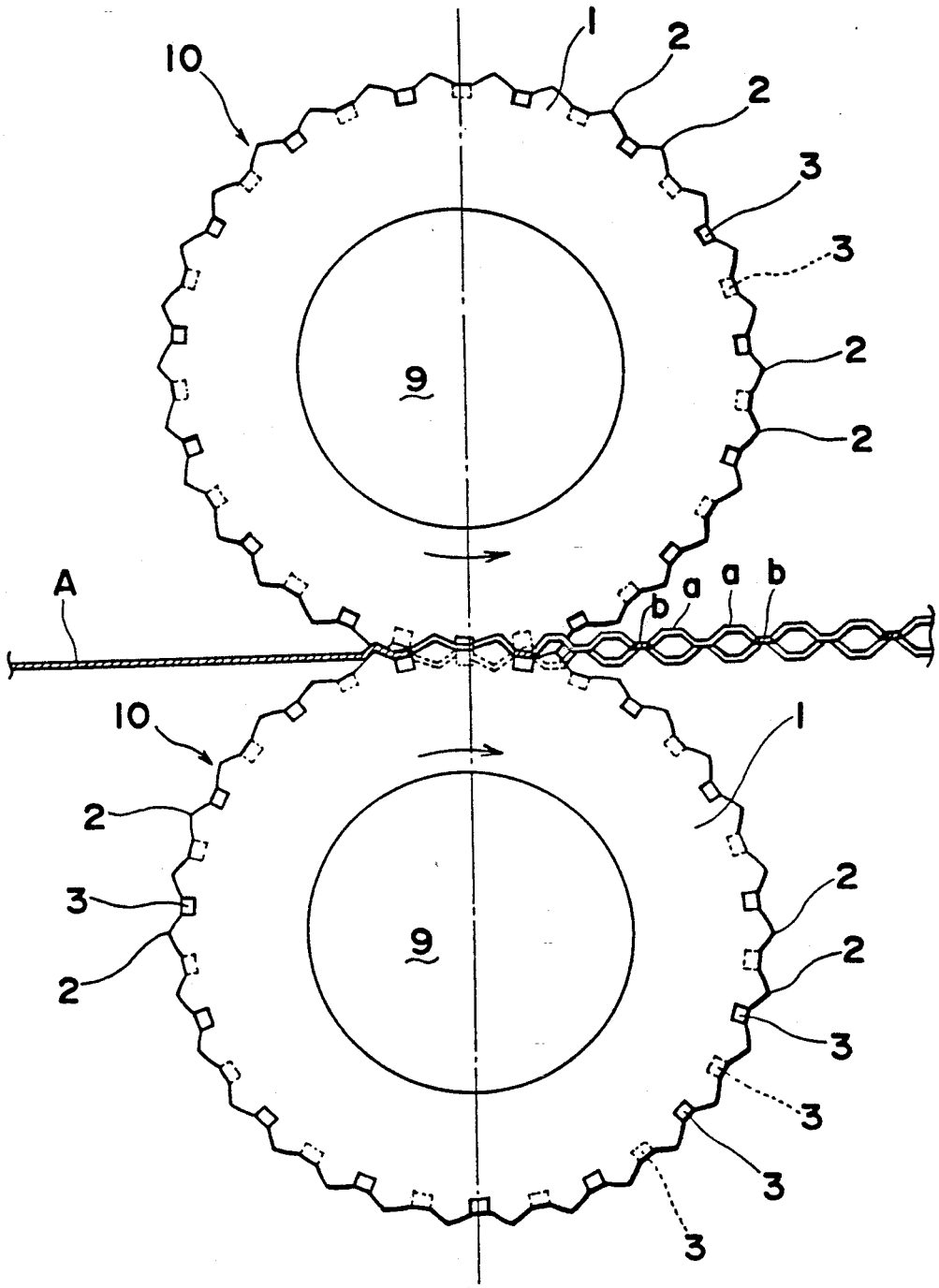
FIG. 1 is a side elevation showing a pair of rolls according to an embodiment of the present invention.

Before the description of the present invention proceeds, it is to be noted that like parts are designated by like reference numerals throughout the accompanying drawings.

The embodiment of the present invention will be described based on FIG. 1 through FIG. 14.

The manufacture of an expanded mesh sheet comprises a first process for providing a strip (A) with a plurality of strip-shaped lift portions (a) and connecting portions (b) for connecting the strip-shaped lift portions (a) with each other and a second process for expanding the strip (A).

Figure 2:
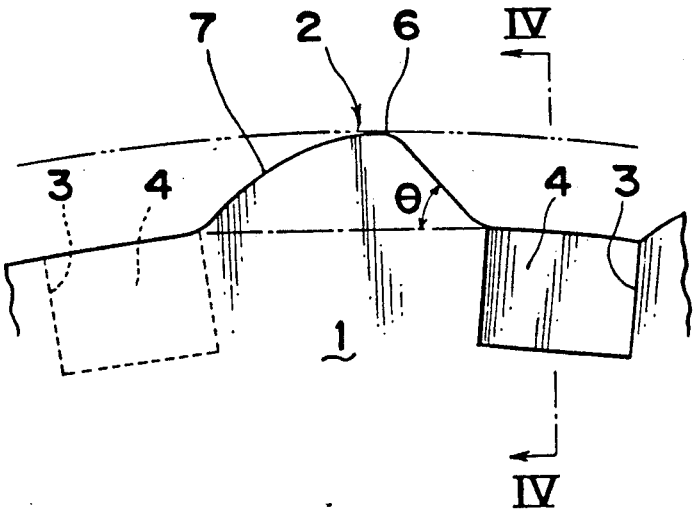
FIG. 2 is a partially side elevation showing the disk-shaped cutter of the roll.
Figure 4:
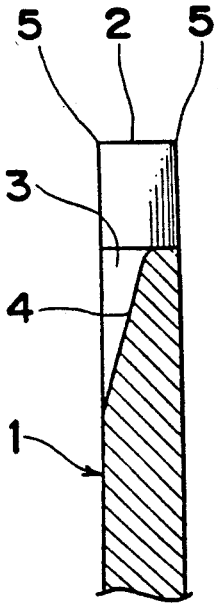
FIG. 4 is a sectional view taken along the line IV—IV shown in FIG. 2.
Figure 3:
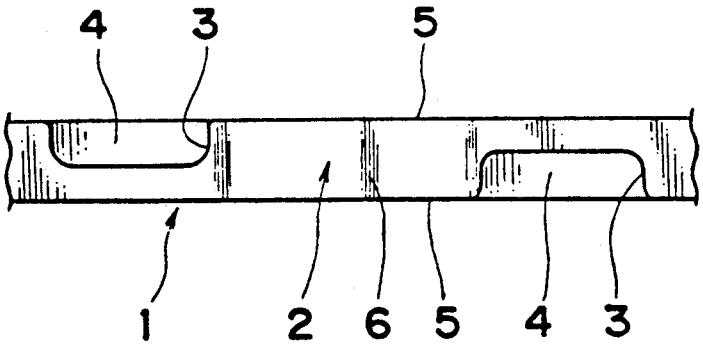
FIG. 3 is a plan view of the cutter.

A disc-shaped cutter 1 as shown in FIG. 1 is used by the device of the first process according to this embodiment. As shown in FIG. 2 through FIG. 4, the disk-shaped cutter 1 has a projection 2 for forming the strip-shaped lift portion (a) and a relief 3 for providing the connecting portion (b) such that the projection 2 and the relief 3 are provided at predetermined pitches in the periphery thereof, respectively. The relief 3 is formed in the shape of a concave groove on one side of a flat portion between adjacent projections 2 and 2, and the groove bottom forms an inclined face 4 with respect to the disk-shaped cutter 1. The relief 3 is so formed by the inclined surface 4 of the periphery of the cutter that a peripheral area of the relief 3 is larger than a bottom area thereof. The relief 3 is alternately formed on both peripheries of the projection 2 in the circumferential direction of the disk-shaped cutter 1. A cutting edge portion 5 for shearing the strip (A), that is, to form a slit in cooperation with the corresponding the cutting edge portion 5 is formed in the edge portion of both sides of the projection 2 and in the edge portion of the side on which the relief 3 of the flat portion is not provided.

The projection 2 is approximately triangular and the top portion 6 thereof is displaced towards the front side relative to the bottom side in the rotational direction of the disk-shaped cutter 1. The front side peripheral portion of the top portion 6 of the projection 2 is approximately strip-shaped when the projection 2 is viewed from the side thereof. The front side peripheral portion has an operation for leading the strip (A) in the feeding direction. Preferably, the angle $\theta_1$ which the front side peripheral portion makes with the bottom of the triangle is in the range of 45°–90°, and the most appropriate range is 55°–75°. The top portion 6 serves as the pulling point in shaping the strip-shaped lift portion (a) into an arch configuration, and preferably, the curvature (R) thereof is as small as 1/2 to 1/1 of the thickness of the strip (A) so that the top portion 6 does not give a bad influence on the strip-shaped lift portion (a). A curved portion 7 externally projecting in the radial direction of the diskshaped cutter 1 is formed on the rear side peripheral portion of the projection 2 so that the pulling points sequentially move backward with the rotation of the diskshaped cutter 1. Thus, the thickness decrease of the rear portion of the strip-shaped lift portion (a) can be prevented from being localized.

Figure 5:
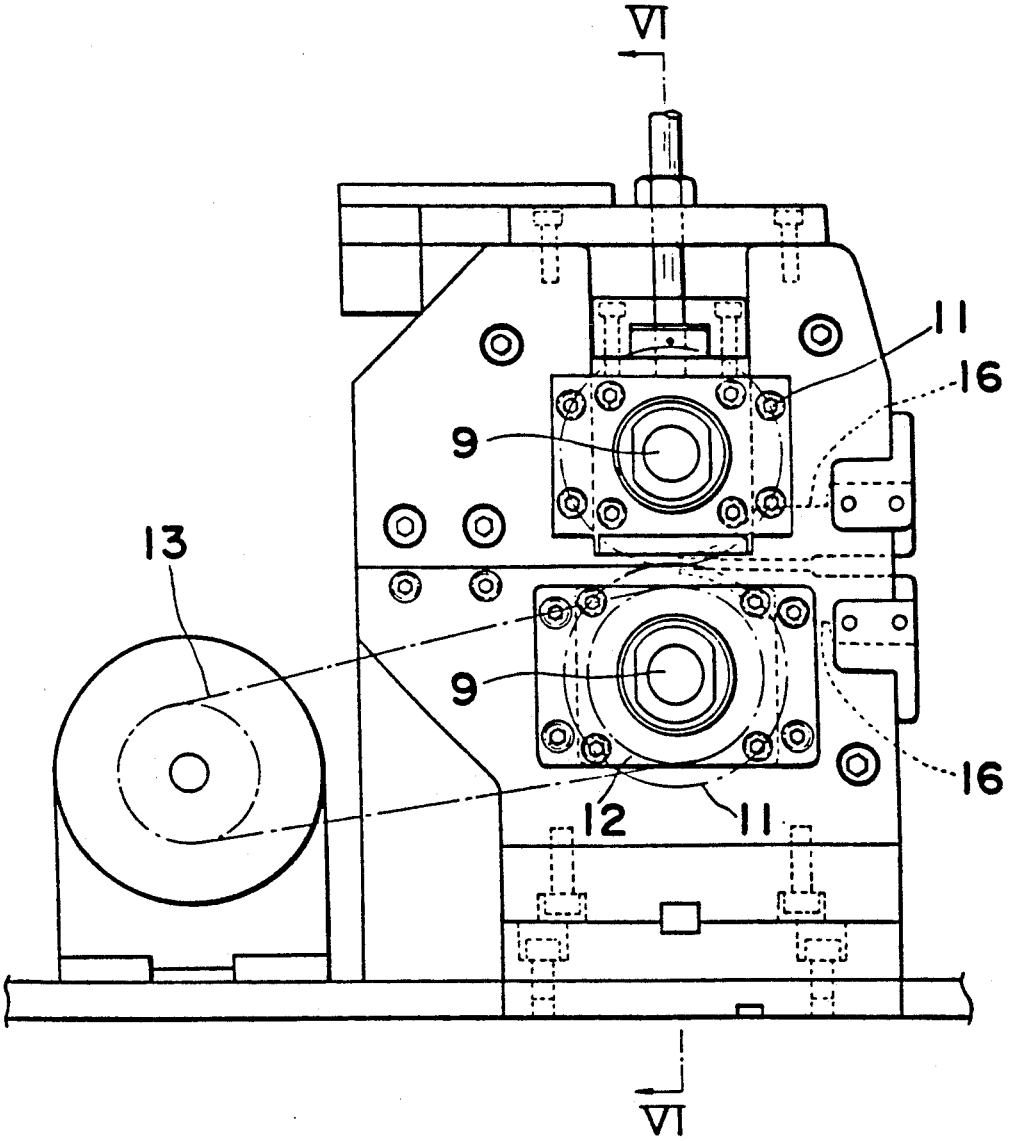
FIG. 5 a side elevation showing the entire structure of the roll.
Figure 6:
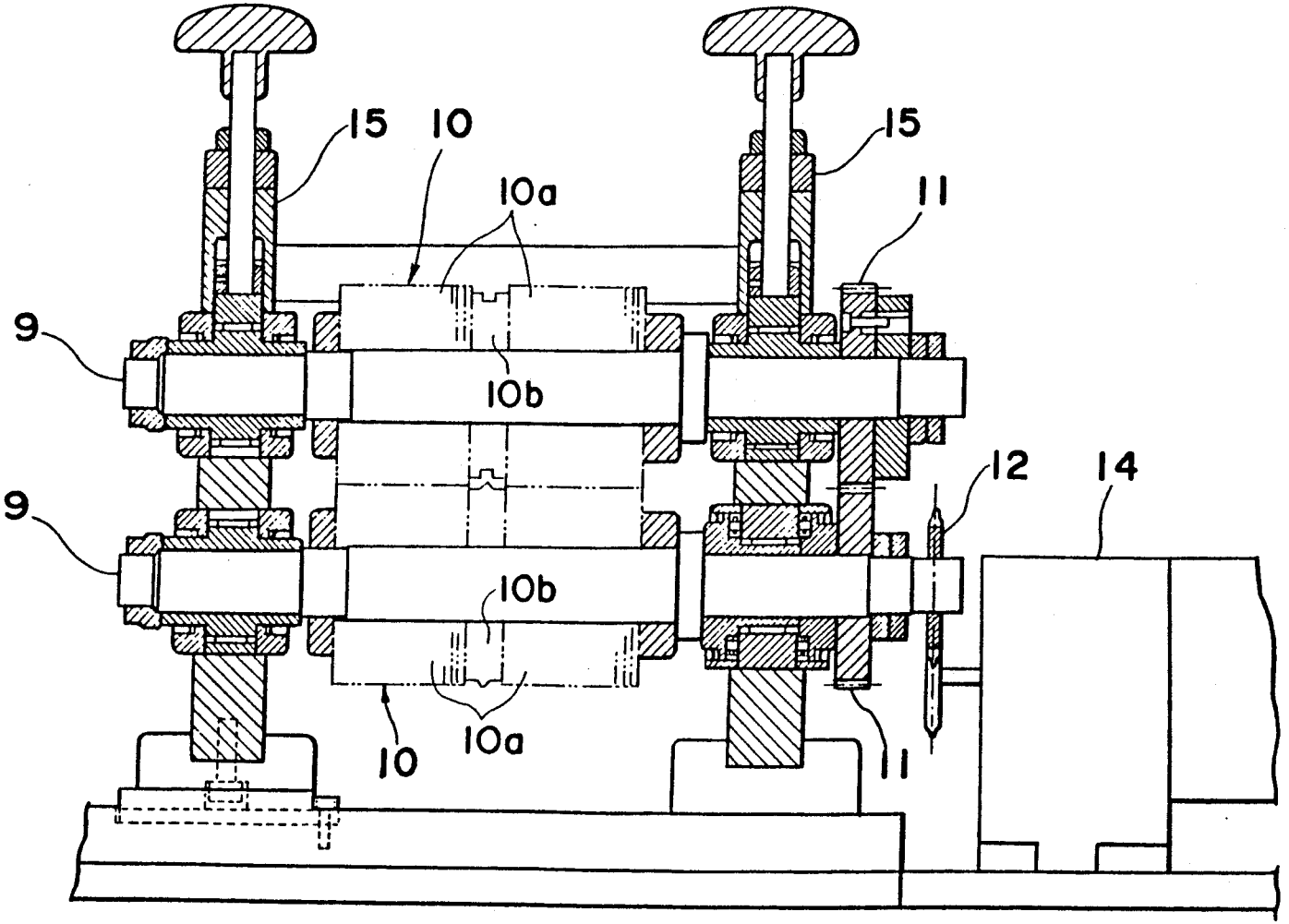
FIG. 6 is a sectional view taken along the line VI—VI shown in FIG. 5.

As shown in FIGS. 5 and 6, the device to be used in the first process comprises a pair of upper and lower rolls 10, in which the disk-shaped cutter 1 and a disk-shaped spacer 8 having a diameter smaller than that of the disk-shaped cutter 1 are superimposed one on the other, which are arranged on a rotational shaft 9. In each roll 10, the projection 2 of the disk-shaped cutter 1 is positioned on a line parallel with the rotational shaft 9, and the reliefs 3 are opposed to each other in the interval between the disk-shaped cutters 1 adjacent to each other. Both rolls 10 are opposed to each other so that the strip (A) is sheared by the engagement between the cutting edge portion 5 of the disk-shaped cutter 1 of one roll 10 and the cutting edge portion 5 of the disk-shaped cutter 1 of the other roll 10 when each relief 3 is positioned on a line connecting both rotational centers (refer to FIG. 9). The disk-shaped cutter 1 is not provided in the center portion in the axial direction of each roll 10 to secure a non-process portion provided in the longitudinal direction in the center portion of the widthwise direction of the strip (A). Both rotational shafts 9 are parallel to each other. Each roll 10 has two roll bodies 10*a* to form the slits and the connecting portions; and a non-process portion 10*b* arranged between the roll bodies 10*a* to form a non-process portion in the center portion of the strip (A).

Each roll 10 is rotatably supported by the main body of the device, and both rolls 10 simultaneously rotate in the direction shown by the arrow through a gear 11 each fixed to one end of each rotational shaft 9. A sprocket 12 is fixed to one end of the rotational shaft 9 the lower roll 10, and the lower roll 10 is driven by a motor 14 (rotation driving means) via a chain 13 spanned around the sprocket 12. The upper roll 10 can be moved vertically by a vertical position adjusting portion 15 provided on the upper end portion of the main body of the device, so that the dimension of the interval between both rolls 10 can be adjusted.

In the main body of the device, in order to forcibly release a sheared portion of the strip (A) from the space between the disk-shaped cutters 1 with the rotation of the roll 10, a comb-shaped stripper 16 is provided in correspondence with each spacer 8 and in noncontact with the spacer 8 and the disk-shaped cutter 1.

Figure 7:
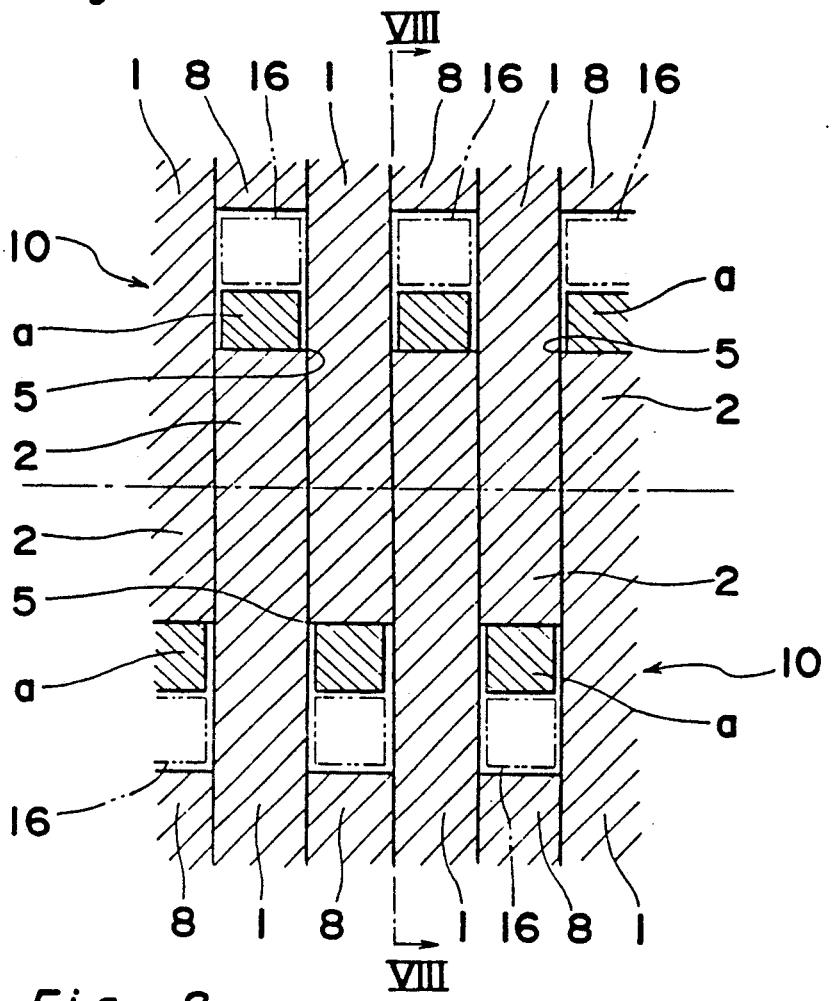
FIG. 7 is a front view of a vertical longitudinal sectional view showing partially the condition in which a strip-shaped lift portions is formed.
Figure 8:
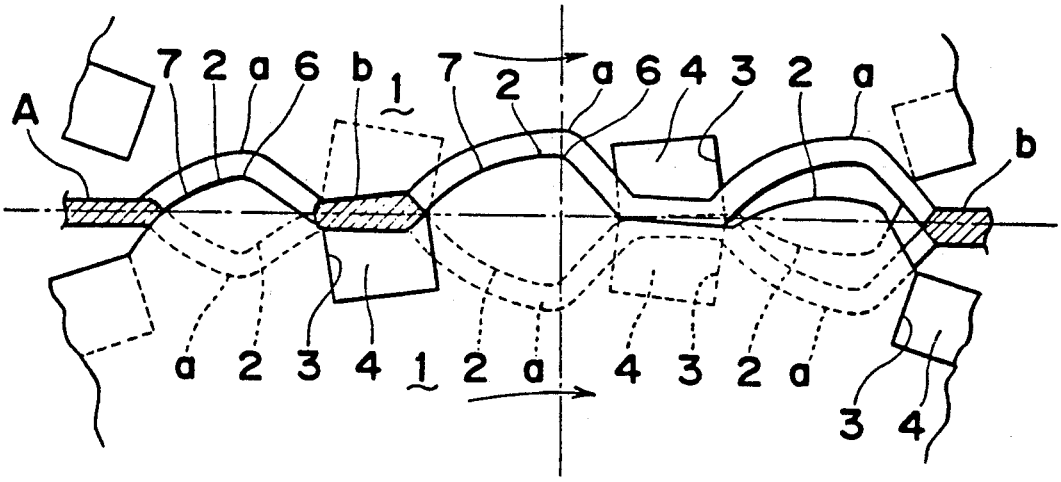
FIG. 8 is a sectional view taken along the line VIII—VIII shown in FIG. 7.
Figure 9:
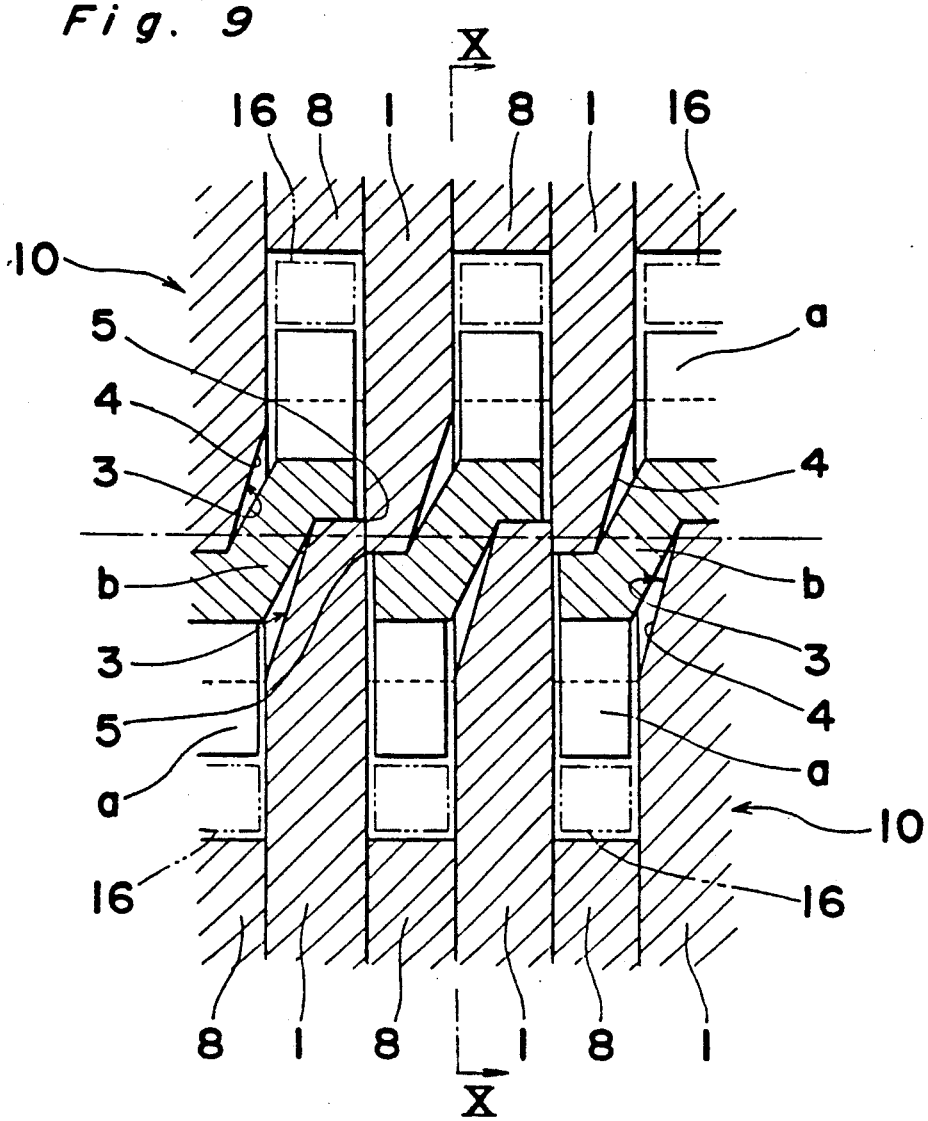
FIG. 9 is a front view of a vertical longitudinal sectional view showing partially the condition in which a connecting portion is formed.
Figure 10:
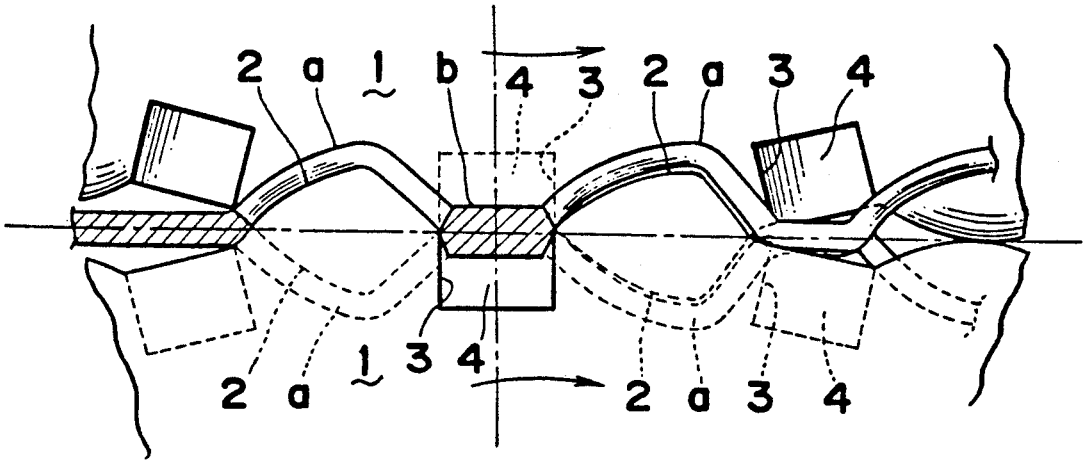
FIG. 10 is a sectional view taken along the line X—X shown in FIG. 9.

In the above construction, in the first process, slits are formed, on the strip (A) fed into the space between both rolls 10, by the cutting edge portions 5 of the opposing disk-shaped cutters 1, and the strip-shaped lift portion (a) is shaped by being bent by the projection 2 as shown in FIGS. 7 and 8, and the slits are made to be intermittent at predetermined pitches between both reliefs 3 to form the connecting portion (b) as shown in FIGS. 9 and 10.

The strip (A) in which the strip-shaped lift portion (a) and the connecting portion (b) have been formed is fed to the second process in which the strip (S) is expanded.

Figure 11:
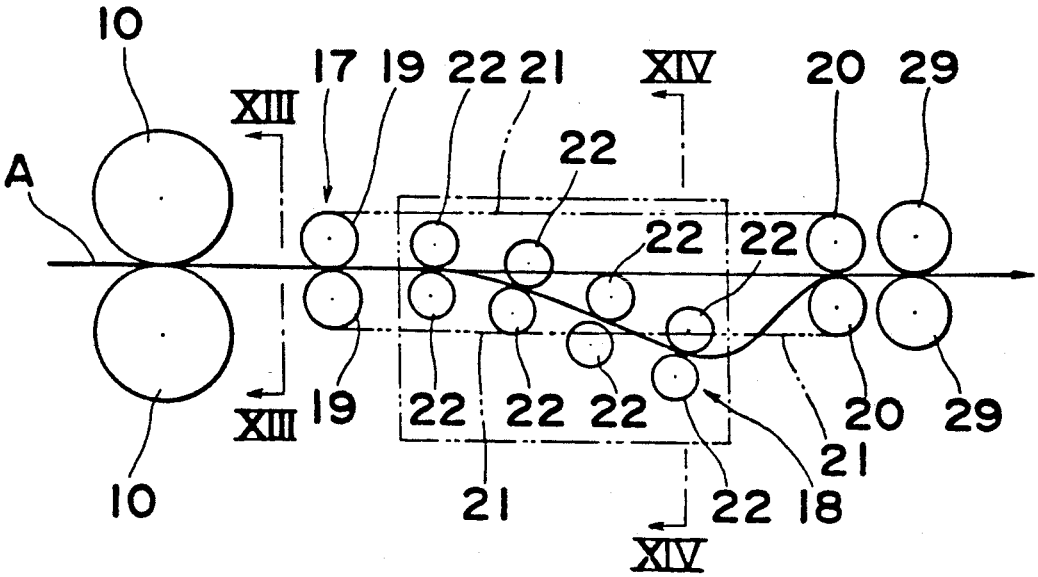
FIG. 11 is a side elevation showing a schematic construction of an expanding apparatus according to the embodiment.

As shown in FIG. 11, the device to be used in the second process comprises a center portion feeding means 17 for supportingly guiding the non-process portion in the center portion of the strip (A) horizontally, an ear portion feeding means 18 for supportingly guiding both ear portions thereof in the feeding direction by moving the ear portions downward, and a flattening means for flattening the expanded strip (A). The center portion feeding means 17 and the ear portion feeding means 18 compose the expanding means according to this embodiment.

Figure 12:
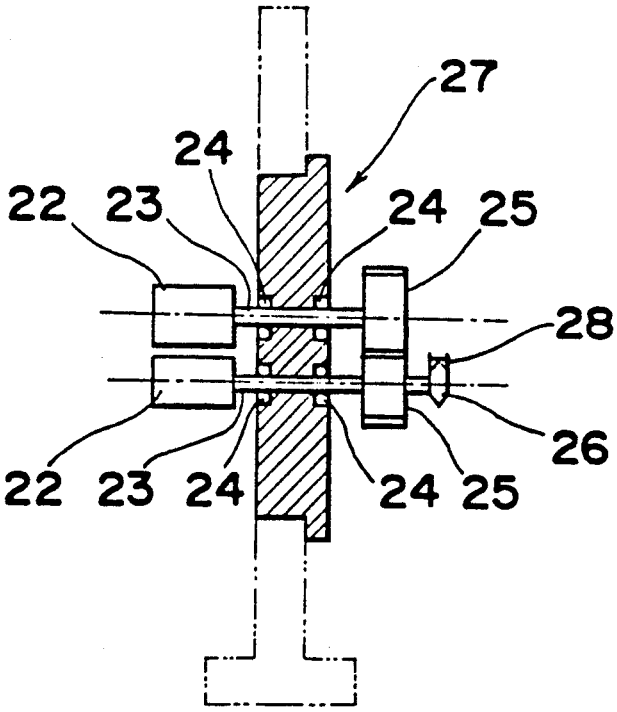
FIG. 12 shows the guide means of the ear portion of the expanded mesh sheet.
Figure 13:
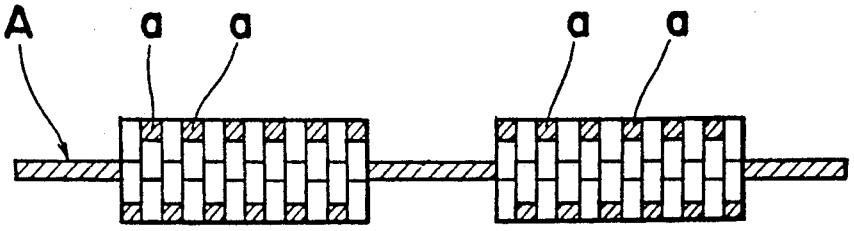
FIG. 13 is a sectional view taken along the line XIII—XIII shown in FIG. 11.
Figure 14:
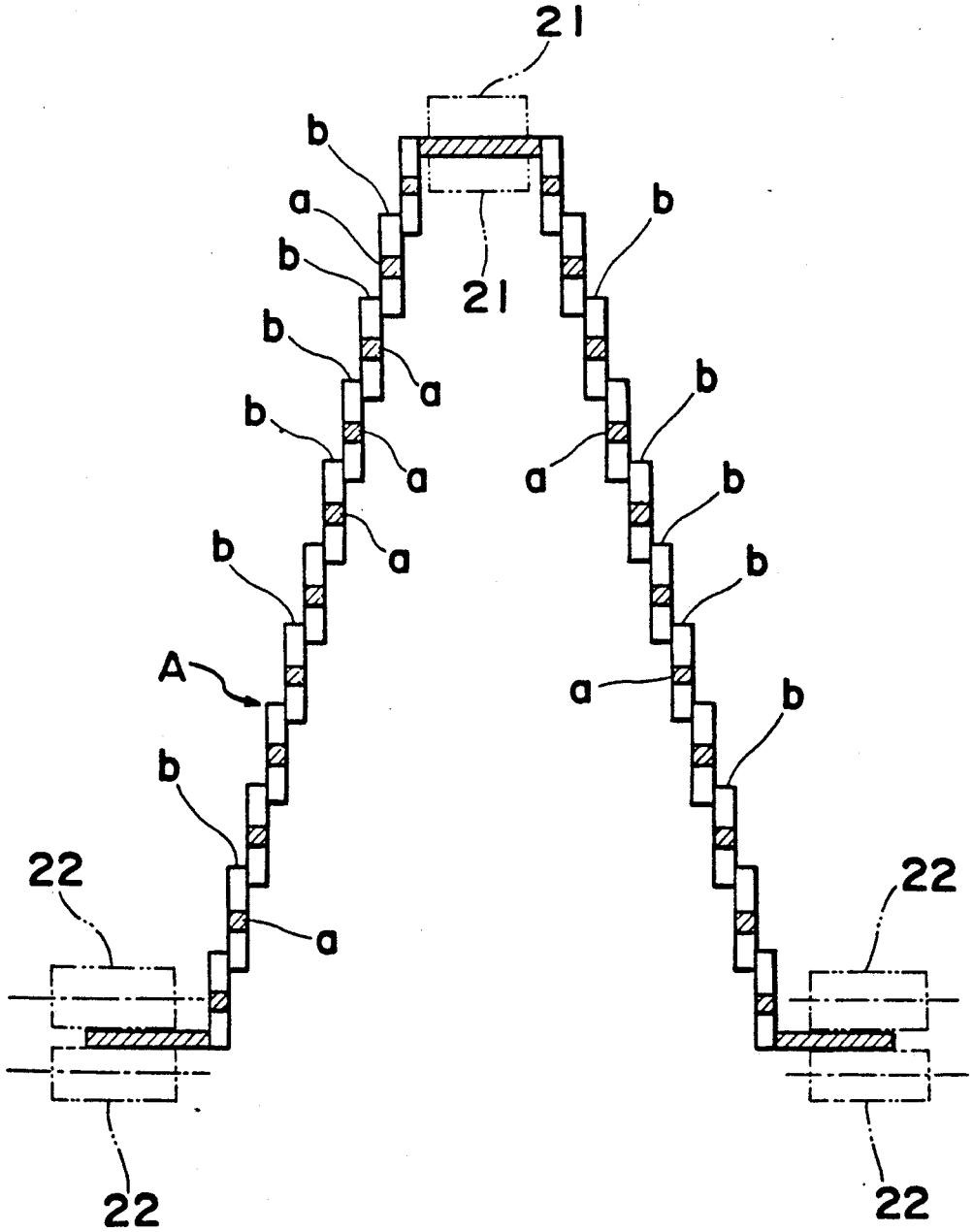
FIG. 14 is a sectional view taken along the line XIV—XIV shown in FIG. 11.
Figure 15A:
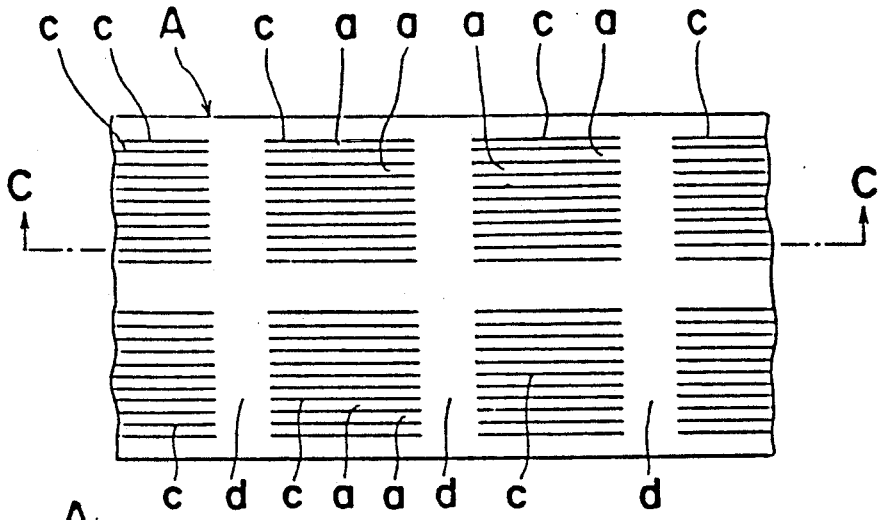
FIGS. 15(*a*) and 15(*b*) are a plan view of a strip formed according to the conventional art and a sectional view taken along the line C—C of FIG. 15(*a*)
Figure 15B:
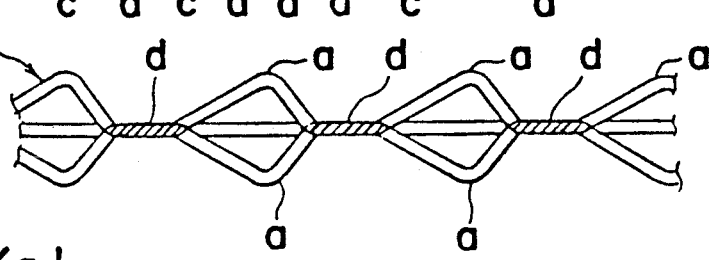
Figure 16A:
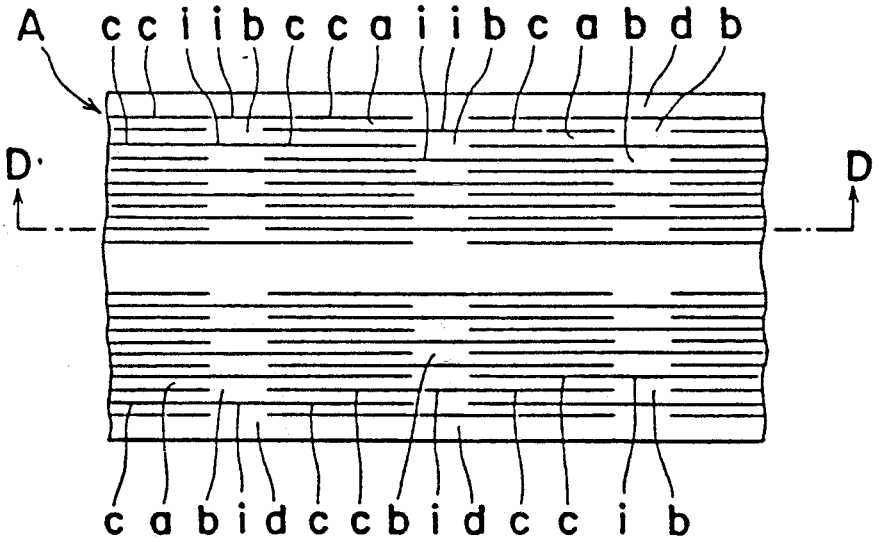
FIGS. 16(*a*) and 16(*b*) a plan view showing a metallic strip having slits formed according to the conventional art and a sectional view taken along the line D—D of FIG. 16(*a*)
Figure 16B:
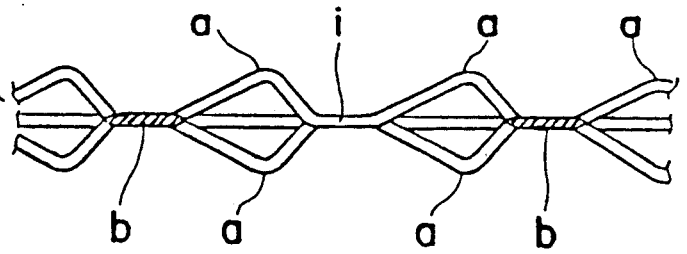
Figure 17:
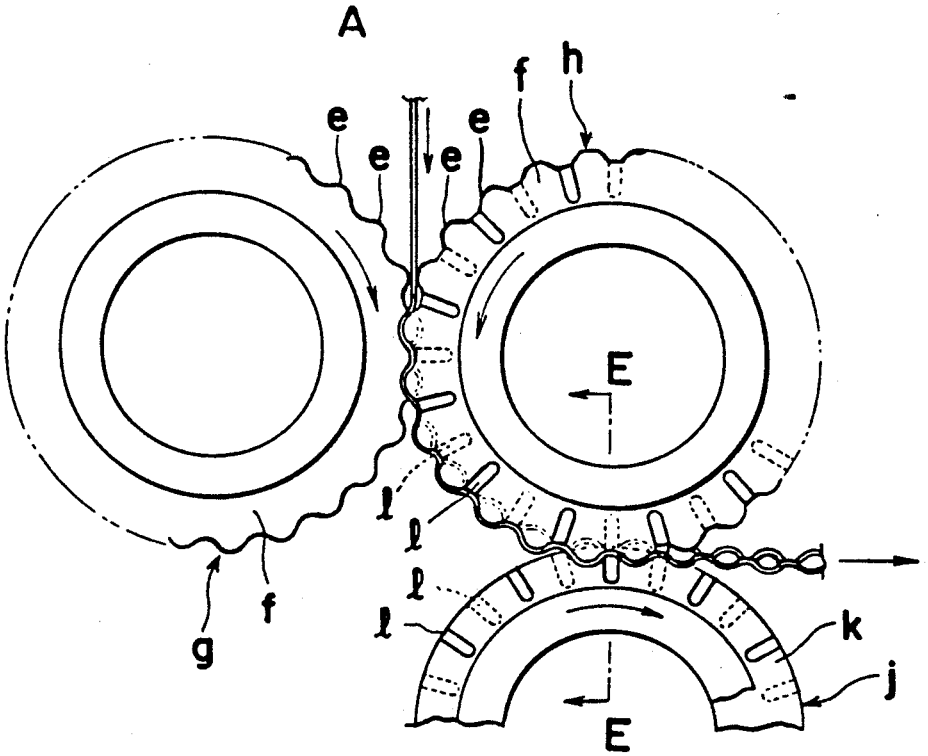
FIG. 17 is a side elevation showing two pairs of rolls to be used for forming slits according to the conventional art.
Figure 18:
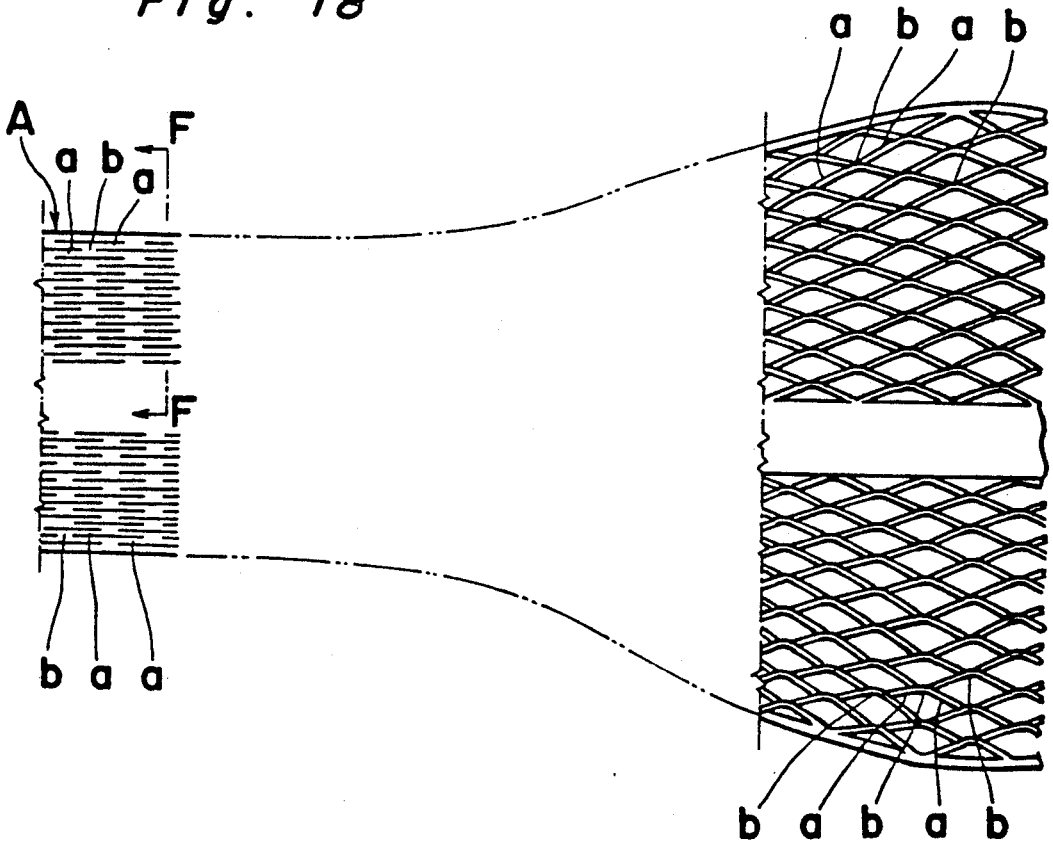
FIG. 18 is a plan view showing an expanded strip.
Figure 19:
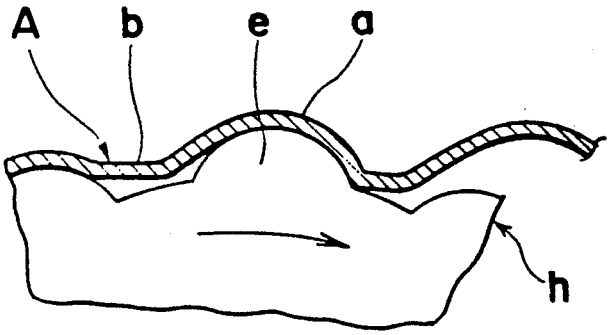
FIG. 19 is a side elevation showing the projection of a disk-shaped cutter of the conventional art.
Figure 20:
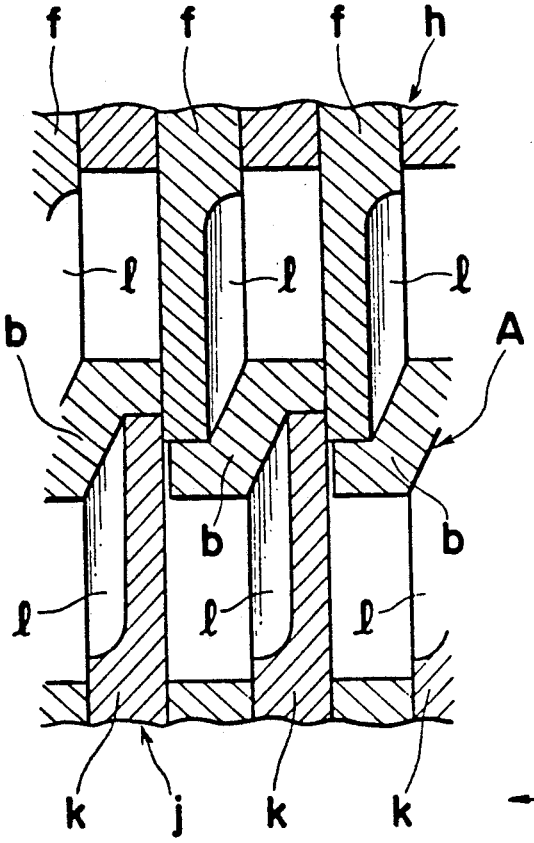
FIG. 20 is a sectional view taken along the line E—E shown in FIG. 17.
Figure 21:
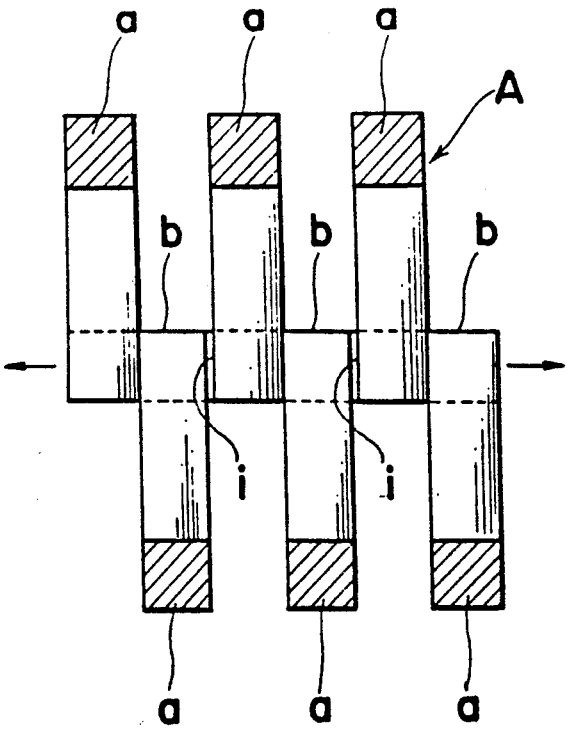
FIG. 21 is a sectional view taken along the line F—F shown in FIG. 18.

In the center portion feeding means 17, an endless belt 21 spanned between a driving roll 19 and a driven roll 20 is provided above and below the strip (A), and the strip (A) is fed by being sandwiched between the upper and lower feeding belts 21. The ear portion feeding means 18 comprises a plurality of units, as shown in FIG. 12, provided on both sides of the strip (A) by vertically adjusting the ear portion holding position of each unit. Each unit comprises a block 27, the vertical position of which is adjustable, having a pair of upper and lower rolls 22 for holding the ear portion of the strip (A) under pressure, a bearing portion 24 for rotatably supporting the rotational shaft 23 of the roll 22, a gear 25 fixed to one end of the rotational shaft 23, and a sprocket 26 fixed to the rotational shaft 23 of the lower roll 22. The roll 22 is driven through a chain 28 spanned around the sprocket 26.

The flattening means comprises a flattening roll 29 which presses the strip (A) both upward and downward.

In the second process of the above construction, the connecting portions (b) adjacent to each other in the widthwise direction of the strip (A) can be separated from each other (refer to FIG. 14) without imparting a twist to the strip-shaped lift portion (a) by applying tensile force perpendicularly to the surface of the strip (A) (refer to FIG. 13) discharged from the first process and by bending each strip-shaped lift portion (a) in the direction in which it has been curvedly shaped.

The bent portion and the non-process portion of the strip (A) thus expanded is made to be flush with each other by the flattening roll 29. Thus, a desired expanded mesh sheet can be obtained.

According to the embodiment, slits for providing the strip-shaped lift portion and the connecting portion can be simultaneously formed by the first process. Therefore, the construction of the disk-shaped cutter and the operation for adjusting the positioning between the two rolls can be simplified. Moreover, according to the embodiment, since the thickness decrease of the strip-shaped lift portion which occurs at the time of shaping by being expanded can be made to be uniform, a thickness reduction can be prevented from locally occurring, and as such, damage can be reduced in expanding. According to the embodiment, since the relief is so formed by an inclined surface of the periphery of the cutter that a peripheral area of the relief is larger than a bottom area thereof, the portion composing the relief of the disk-shaped cutter can be reinforced, so that damage of the disk-shaped cutter can be suppressed. According to the embodiment, since the apparatus further comprises an expanding means for expanding the strip having the strip-shaped lift portion and the connecting portion in an approximately thickness direction of the strip except for a center portion of the strip in a widthwise direction of the strip, the strip can be expanded uniformly and with a comparatively small force.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A method of manufacturing an expanded mesh sheet, comprising the steps of:

simultaneously forming a plurality of slits at predetermined pitches in both the longitudinal direction of the strip and in the widthwise direction of the strip with adjacent ones of said slits in the widthwise direction being offset from one another in the longitudinal direction of the strip so as to simultaneously produce a plurality of strip-shaped lift portions extending in the longitudinal direction of the strip between respective portions of the slits which are adjacent one another in the widthwise direction of the strip and connecting portions connecting the strip-shaped list portions to each other in a lattice pattern; and subsequently expanding the strip in the widthwise direction thereof.

2. A method of manufacturing an expanded mesh sheet as claimed in claim 1, wherein the step of simultaneously forming the slits in both the longitudinal and widthwise directions of the strip, with adjacent ones of said slits in the widthwise direction being offset from one another, consists of conveying the strip in the longitudinal direction thereof between two continuously rotating cutter rolls in meshing coacting engagement.

3. A method of manufacturing an expanded mesh sheet as claimed in claim 1, wherein the step of expanding the strip in the widthwise direction thereof comprises applying a tensile force to the strip in a direction perpendicular to the plane thereof which causes the strip-shaped lifting portions to be displaced in said direction perpendicular to the plane of the strip, and subsequently flattening the strip in a manner which forces the strip to expand in the widthwise direction thereof.

* * * * *